US012523056B2

(12) United States Patent
Bautz et al.

(10) Patent No.: US 12,523,056 B2
(45) Date of Patent: Jan. 13, 2026

(54) STACKABLE BURIAL TOWER

(71) Applicants: Pamela D. Bautz, Mansfield, OH (US); Adam J. Longstreth, Mansfield, OH (US)

(72) Inventors: Pamela D. Bautz, Mansfield, OH (US); Adam J. Longstreth, Mansfield, OH (US)

( * ) Notice: Subject to any disclaimer, the term of this patent is extended or adjusted under 35 U.S.C. 154(b) by 209 days.

(21) Appl. No.: 18/470,053

(22) Filed: Sep. 19, 2023

(65) Prior Publication Data

US 2024/0093527 A1 Mar. 21, 2024

Related U.S. Application Data

(60) Provisional application No. 63/407,796, filed on Sep. 19, 2022.

(51) Int. Cl.
*E04H 13/00* (2006.01)

(52) U.S. Cl.
CPC ..... *E04H 13/008* (2013.01)

(58) Field of Classification Search
CPC ..... E04H 13/008; A61G 17/08
USPC ..... 52/103
See application file for complete search history.

(56) References Cited

U.S. PATENT DOCUMENTS 3,925,944 A * 12/1975 Pickel ..... E04H 13/006 52/133
4,521,999 A 6/1985 Flanagan
4,688,359 A * 8/1987 See ..... A61G 17/08 52/28
5,815,897 A * 10/1998 Longstreth ..... E04H 13/003 47/79
6,167,600 B1 * 1/2001 Williams ..... E04H 13/006 27/35
6,250,025 B1 6/2001 Darby
6,421,890 B1 * 7/2002 Biggar ..... A61G 17/08 220/23.88

(Continued)

FOREIGN PATENT DOCUMENTS

AT 8819 U1 1/2007
CN 213269200 U 5/2021

(Continued)

OTHER PUBLICATIONS

Columbarium Niches, "2 Column—Single-Sided Memorial Columbarium", webpage, columbariumniches.com, Sku# N1032470, US, https://www.columbariumniches.com/products/2-column-single-sided-memorial-columbarium.

(Continued)

*Primary Examiner* — James J Buckle, Jr.
(74) *Attorney, Agent, or Firm* — Jacob M. Ward; Ward Law Office LLC

(57) ABSTRACT

A stackable burial tower configured to store cremated remains is provided. The stackable burial tower includes a base member and a plurality of intermediate blocks. Each of the plurality of intermediate blocks is configured to stack on the base member or on each other thereby, in combination with the base member, forming a tower. A spinal structure extends from the base member through the plurality of intermediate blocks and a plurality of chamber vessels are configured to store cremated remains, each of the plurality of chamber vessels positioned within one of the plurality of intermediate blocks.

13 Claims, 5 Drawing Sheets

(56) References Cited

U.S. PATENT DOCUMENTS

| | | | | |
|---|---|---|---|---|
| 6,493,911 | B1 * | 12/2002 | Troin | E04H 13/008 125/20 |
| 6,520,606 | B1 | 2/2003 | Robinson | |
| 7,171,733 | B2 * | 2/2007 | Min | E04H 13/006 27/35 |
| 7,478,461 | B2 * | 1/2009 | Glass | A61G 17/007 27/35 |
| 7,562,423 | B2 | 7/2009 | Pryd-Kakuk | |
| 7,739,776 | B2 | 6/2010 | Hume | |
| 8,510,921 | B2 | 8/2013 | Florea | |
| 8,959,731 | B2 * | 2/2015 | Lynch | A61G 17/0136 431/291 |
| 8,966,725 | B2 * | 3/2015 | Langelier | A61G 99/00 27/35 |
| 9,290,960 | B1 * | 3/2016 | McHale | E04H 13/00 |
| D854,776 | S * | 7/2019 | Eickhof | D99/25 |
| 10,486,855 | B1 * | 11/2019 | Pollman | B65D 21/0228 |
| 11,285,067 | B2 | 3/2022 | Conrad | |
| 12,084,877 | B2 * | 9/2024 | Griggs | A61G 17/08 |
| 2017/0298648 | A1 | 10/2017 | Eickhof et al. | |
| 2020/0181933 | A1 | 6/2020 | Lockhart | |

FOREIGN PATENT DOCUMENTS

| | | | |
|---|---|---|---|
| FR | 2722229 | A1 | 1/1996 |
| TW | M602897 | U | 10/2020 |
| WO | 2022198280 | A1 | 9/2022 |

OTHER PUBLICATIONS

Columbarium USA, "Columbarium USA—The Heritage", webpage, columbariumusa.com, Canada, https://www.columbariumusa.com/the-heritage/.

Written Opinion of the International Searching Authority dated Jan. 26, 2024.

* cited by examiner

STACKABLE BURIAL TOWER

RELATED APPLICATIONS

This application claims the benefit of U.S. Provisional Application No. 63/407,796 filed on Sep. 19, 2022. The disclosure of the above application is hereby incorporated herein by reference in its entirety.

FIELD

The present disclosure relates generally to structures for memorializing the remains of deceased persons, and more specifically, configurable to form a stackable and stand-alone burial tower.

INTRODUCTION

This section provides background information related to the present disclosure which is not necessarily prior art.

Cremation of a deceased individual has become an increasingly popular end of life option. For social, economic and religious reasons, people have turned to cremation of the remains of a deceased as an acceptable alternative to preservation and burial of the remains. Whether the remains of a deceased are preserved and buried or cremated, traditionally, there is a time-honored need for memorialization of the deceased. Memorialization provides a visual symbol that functions as a reminder of the deceased. In most cases, this visual symbol is simply a location where the remains of an individual are afforded a physical resting place that can be identified by name and dates. Most families find that a memorial, regardless of its size, serves a basic human need to remember and to be remembered. Notwithstanding the foregoing, preparation of a deceased's remains by cremation, as with traditional burial, is simply one step in the memorialization process. Once a deceased's remains have been cremated, the final disposition of the cremated remains and the memorial selected for the remains must be selected. Such memorials are varied and numerous.

One option for storing remains is a permanent container that can stay with the deceased individual's family such as an urn. Others may choose to bury the remains in a cemetery plot. Furthermore, some individuals may wish to have their remains spread in a location of significance, such as a garden. Still yet another option for the memorialization of cremated remains is in a columbarium.

A columbarium is an indoor or outdoor wall containing niches or recessed compartments in which urns are placed. Columbariums can include permanent structures that typically range in size from entire buildings to individual walls. Such walls may be incorporated in rooms, chambers, alcoves, mausoleums, chapels or similar structures or may be freestanding. The niches of columbariums typically come in many sizes to accommodate the numerous and varied selection of urns that are available. Some niches are capable of containing two or more urns, such as for families. Niche coverings may be glass, marble, bronze, mosaic, granite or the like.

One drawback of burying remains or using a columbarium is plot or land space. Most cemeteries have a limited amount of land that they can sell as plots for burial or columbariums. Commonly, cemeteries are land locked and do not have the ability to buy more land to accommodate more individuals. Additionally, cemeteries may have space that cannot be used as a burial plot due to the shape of the cemetery. In such a case, the cemetery can have unusable and dead space that goes wasted. Further, with respect to burial plots, it can be difficult for families to add new burial plots upon the death of a loved one. Burial plots are typically bought in a grouping and a family may not be able to adequately plan for the number of plots they will require when the group is bought. For example, a family may have an individual pass and purchase enough plots for their current family. However, in the future, their family may expand, and the burial plots purchased may not account for the new members of the family. In these cases, families can be forced to split up. Sadly, this can cause families to be separated across a single cemetery or even multiple cemeteries.

There is a continuing need for means to store remains in an expandable structure. Desirably, the expandable structure is space conscious and allows for individualization and customization.

SUMMARY

In concordance with the instant disclosure, means to store remains in an expandable structure, which is space conscious and allows for individualization and customization, has been surprisingly discovered.

It should be appreciated that this Summary is provided to introduce a selection of concepts in a simplified form, the concepts being further described below in the Detailed Description. This Summary is not intended to identify key features or essential features of this disclosure, nor is it intended to limit the scope of the stackable burial tower.

The above objects as well as other objects not specifically enumerated are achieved by a stackable burial tower configured to store cremated remains. The stackable burial tower includes a base member and a plurality of intermediate blocks. Each of the plurality of intermediate blocks is configured to stack on the base member or on each other thereby, in combination with the base member, forming a tower. A spinal structure extends from the base member through the plurality of intermediate blocks and a plurality of chamber vessels are configured to store cremated remains, each of the plurality of chamber vessels positioned within one of the plurality of intermediate blocks.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
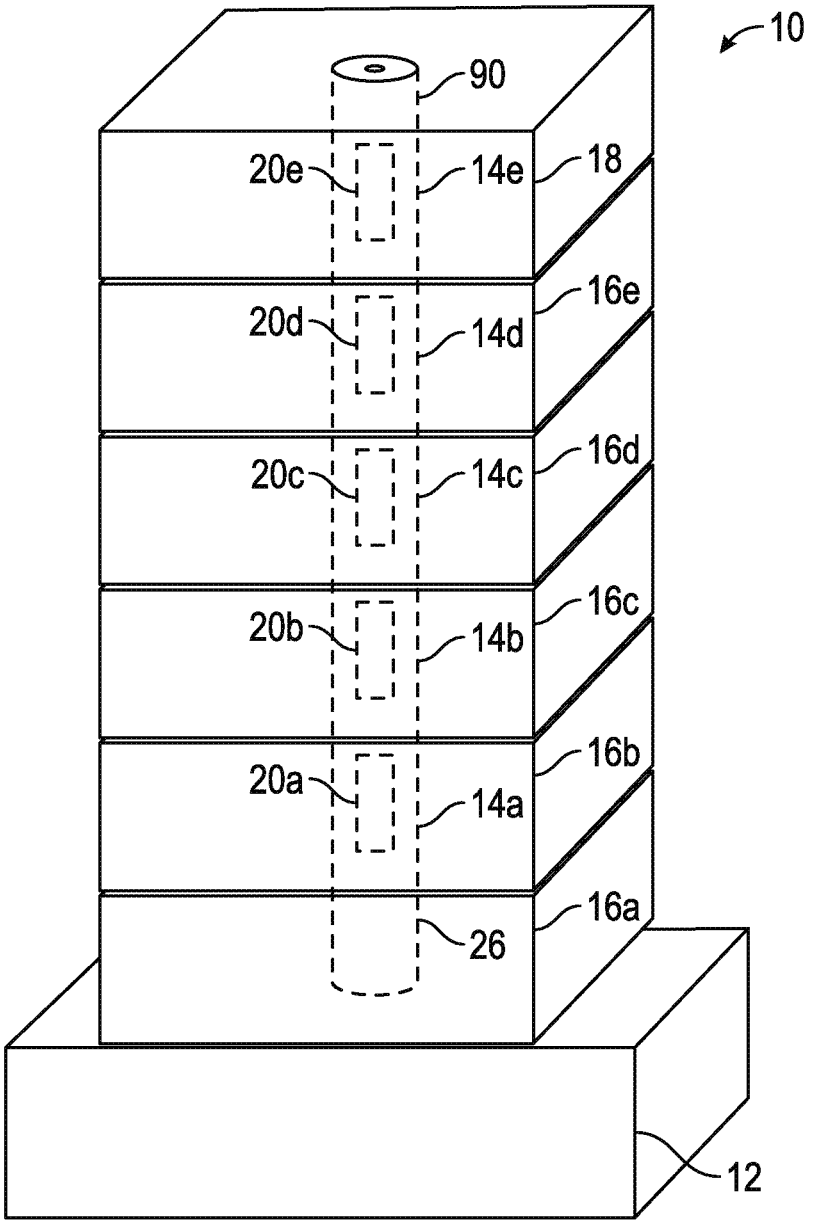
FIG. 1 is a front view of a first embodiment of a stackable burial tower, in accordance with one embodiment of the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology includes a novel stackable burial tower. Generally, the novel stackable burial tower has a spinal structure connected to a base member. The spinal structure is configured to support a plurality of intermediate blocks and a cap block. A plurality of chamber vessels are enclosed within the spinal structure, with each of the chamber vessels configured to secure and store cremated remains.

Figure 2:
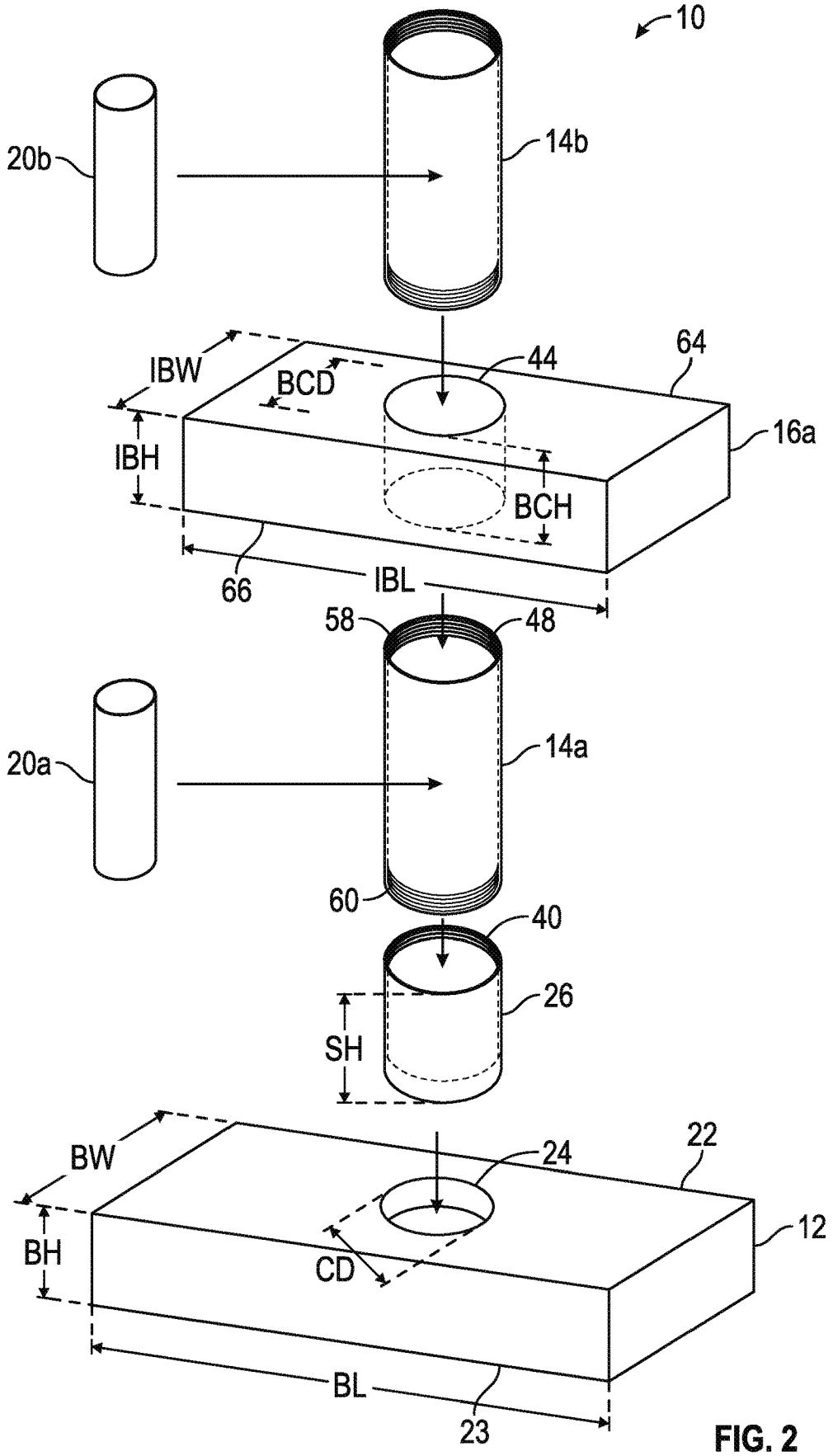
FIG. 2 is an exploded perspective view of a portion of the stackable burial tower of FIG. 1.

Referring now to FIGS. 1 and 2, a stackable burial tower is illustrated generally at 10. The stackable burial tower 10 provides a structure configured to store and memorialize the cremated remains of one or more persons in an aesthetically pleasing, stand alone and space conscious manner. The burial tower 10 includes a base member 12, a plurality of housing chambers 14*a*-14*e*, a plurality of intermediate blocks 16*a*-16*e*, a cap block 18, a plurality of chamber containers 20*a*-20*e*, a base sleeve 26 and a cap sleeve 90. Generally, the housing chambers 14*a*-14*e* are hollow members and are configured to interlock with adjacent housing chambers 14*s*-14*e* in a manner such as to form a spinal structure configured to support the intermediate blocks 16*a*-16*e* and the cap block 18 as well as providing an enclosed housing for the cremated remains of one or more persons.

Referring again to FIGS. 1 and 2, the base member 12 can be formed of various materials, including any natural stone material. As a non-limiting example, the base member 12 can be formed of a granite-based material. As the burial tower 10 can be positioned outside in a cemetery and the base member 12 can sit upon the ground, a sturdy and weather-proof material is required. Advantageously, a granite-based material can provide additional stability and longevity for the burial tower 10. One of ordinary skill in the art can select other suitable materials for forming the base member 12 within the scope of the present disclosure.

Referring now to FIG. 2, the base member 12 has a base length BL, a base width BW and a base height BH. The base length BL, base width BW and base height BH are configured to create a stable platform for the burial tower 10. In the illustrated embodiment, the base length BL is in a range of from about 20.0 inches to about 40.0 inches, the base width BW is in a range of from about 10.0 inches to about 20.0 inches and the base height BH is in a range of from about 5.0 inches to about 12.0 inches. However, it should be appreciated that in other embodiments, the base length BL can be less than about 20.0 inches or more than about 40.0 inches, the base width BW can be less than about 10.0 inches or more than about 20.0 inches and the base height BH can be less than about 5.0 inches or more than about 12.0 inches, sufficient to create a stable platform for the burial tower 10. Advantageously, the above listed dimensions for the base length BL, the base width BW and the base height BH conform with current grave space standards and thus eliminate the need for grave space resizing.

While the base member 12 is shown in FIGS. 1 and 2 as having a cross-sectional shape of a rectangle, it should be appreciated that in other embodiments, the base member 12 can have other cross-sectional shapes. Non-limiting examples of other cross-sectional shapes include squares, triangles and circles.

Referring now to FIG. 2, the base member 12 includes an upper face 22 and an opposing lower face 23. A base cavity 24 is formed and extends from the upper face 22 in a direction toward the lower face 23. The base cavity 24 is configured to receive a base sleeve 26. In the illustrated embodiment, the base cavity 24 has a circular cross-sectional shape that approximates a circular cross-sectional shape of the base sleeve 26. The base cavity 24 has a cavity height CH that approximates a sleeve height SH of the base sleeve 26. The cavity cross-sectional shape, cavity height CH, sleeve cross-sectional shape and the sleeve height SH are arranged in a manner such that in an assembled orientation, the entirety of the base sleeve 26 is contained in the base cavity 24. In the illustrated embodiment, a diameter CD of the base cavity 24 is in a range of from about 4.0 inches to about 8.0 inches and the cavity height CH is in a range of from about 2.0 inches to about 4.0 inches. It should be appreciated that in other embodiments, the diameter CD of the base cavity 24 can be less than about 4.0 inches or more than about 8.0 inches and the cavity height CH can be less than about 2.0 inches or more than about 4.0 inches, sufficient for the functions described herein.

Figure 3:
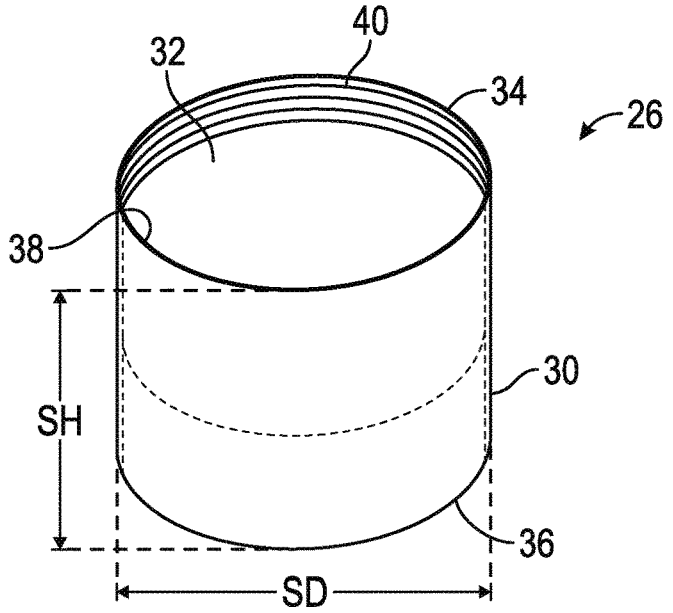
FIG. 3 is a front perspective view of a base sleeve of the stackable burial tower of FIG. 1.

Referring now to FIGS. 2 and 3, the base sleeve 26 is illustrated. The base sleeve 26 is configured for several functions. First, the base sleeve 26 is configured for seating within the base cavity 24. Second, the base sleeve 26 is configured for attachment to the housing chamber 14*a*. The base sleeve 26 includes a circumferential wall 30 that defines a sleeve cavity 32. The sleeve cavity 32 extends from an upper rim 34 in a direction toward a bottom surface 36. The circumferential wall 30 forms an inner surface 38. A plurality of sleeve threads 40 are formed on the inner surface 38 adjacent to the upper rim 34. As will be discussed in more detail below, the plurality of sleeve threads 40 will engage mating threads formed on the housing chamber 14*a*.

Referring again to FIGS. 2 and 3, the base sleeve 26 can be formed from any non-deteriorating material. As a non-limiting example, the base sleeve 26 can be formed from composite plastic materials, aluminum-based materials, and stainless-steel based materials. Desirably, the above materials can provide a long-lasting storage solution for cremains. One of ordinary skill in the art can select other suitable materials for forming the base sleeve within the scope of the present disclosure.

Referring again to the embodiment illustrated in FIGS. 2 and 3, a diameter SD of the base sleeve 26 is in a range of from about 4.0 inches to about 8.0 inches and a sleeve height SH is in a range of from about 2.0 inches to about 4.0 inches. It should be appreciated that in other embodiments, the diameter SD of the base sleeve 26 can be less than about 4.0 inches or more than about 8.0 inches and the sleeve height SH can be less than about 2.0 inches or more than about 4.0 inches, sufficient for the functions described herein.

Figure 4:
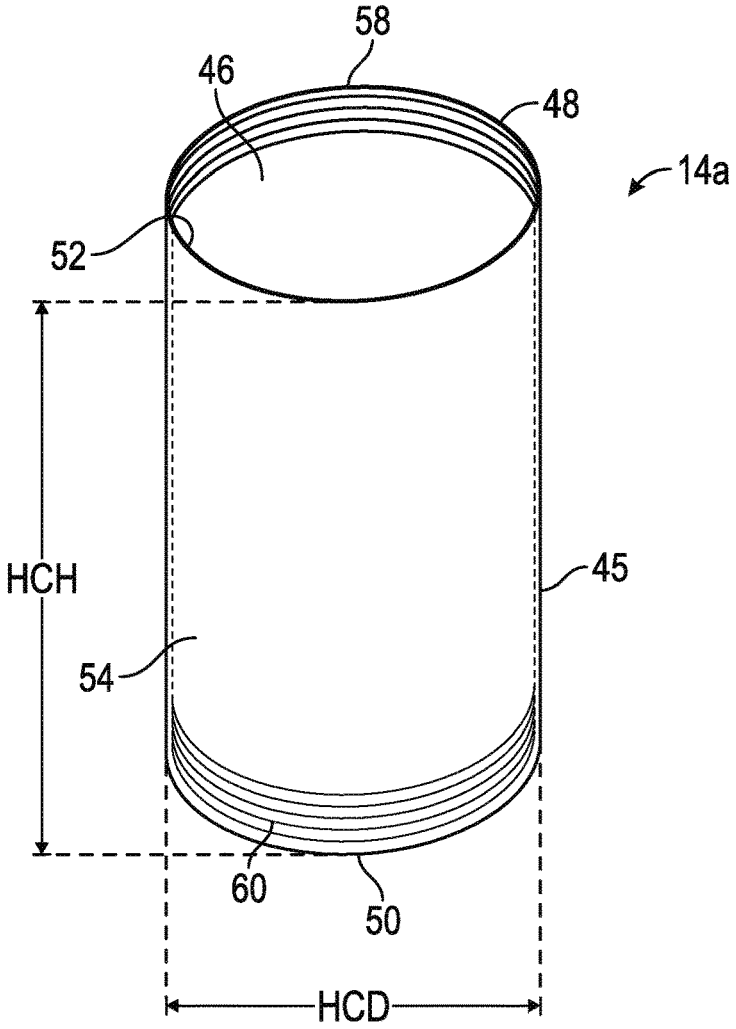
FIG. 4 is a front perspective view of a housing chamber of the stackable burial tower of FIG. 1.

Referring now to FIGS. 2 and 4, the housing chamber 14*a* is illustrated. The housing chamber 14*a* is representative of the housing chambers 14*b*-14*e*. The housing chamber 14*a* is configured for several functions. First, the housing chamber 14*a* is configured for attachment with the base sleeve 26. Second, the housing chamber 14*a* is configured for placement within a block cavity 44 of the intermediate block 16*a*. Third, the housing chamber 14*a* is configured for attachment to an adjacent housing chamber 14*b*. Finally, the housing chamber 14*a* is configured to receive, secure and store the chamber vessel 20*a*.

Referring again to FIGS. 2 and 4, the housing chamber 14*a* includes a circumferential wall 45 that defines a housing chamber cavity 46. The housing chamber cavity 46 extends from an upper rim 48 to a lower rim 50. The circumferential wall 45 forms an inner surface 52 and an outer surface 54. A plurality of inner housing chamber threads 58 are formed on the inner surface 52 adjacent the upper rim 48 and a plurality of outer housing chamber threads 60 are formed on the outer surface 54 adjacent the lower rim 50. As will be discussed in more detail below, the plurality of inner housing chamber threads 58 will engage mating threads formed on subsequently installed housing chamber 14*b* and the plurality of outer housing chamber threads 60 will engage the sleeve threads 40 formed within the base sleeve 26.

Referring again to FIGS. 2 and 4, the housing chamber 14*a* can be formed from any non-deteriorating material. As a nonlimiting example, the housing chamber 14*a* can be formed from composite plastic materials, aluminum-based materials, and stainless-steel based materials. Desirably, the above materials can provide a long-lasting storage solution for cremains. One of ordinary skill in the art can select other suitable materials for forming the housing chamber 14*a* within the scope of the present disclosure.

Referring again to the embodiment illustrated in FIGS. 2 and 4, a diameter HCD of the housing chamber 14*a* is in a range of from about 4.0 inches to about 8.0 inches and a housing chamber height HCH is in a range of from about 6.0 inches to about 14.0 inches. It should be appreciated that in other embodiments, the diameter HCD of the housing chamber 14*a* can be less than about 4.0 inches or more than about 8.0 inches and the housing chamber height HCH can be less than about 6.0 inches or more than about 14.0 inches, sufficient for the functions described herein.

Referring now to FIGS. 1 and 2, the intermediate block 16*a* is illustrated. The intermediate block 16*a* is representative of the intermediate blocks 16*b*-16*e*. The intermediate block 16*a* is configured for several functions. First, the intermediate block 16*a* is configured to receive one of the housing chambers 14*a*-14*e* through the block cavity 44. Second and optionally, the intermediate block 16*a* is configured to provide visual surfaces for indicia. Finally, the intermediate block 16*a* is configured to assist in providing structural integrity to the burial tower 10.

Referring again to FIGS. 1 and 2, intermediate block 16*a* can be formed of various materials, including any natural stone material. As a non-limiting example, the intermediate block 16*a* can be formed of a granite-based material. As the burial tower 10 can be positioned outside in a cemetery, and the intermediate block 16*a* can be exposed to the natural elements, a sturdy and weather-proof material is required. Advantageously, a granite-based material can provide additional stability and longevity for the burial tower 10. One of ordinary skill in the art can select other suitable materials for forming the intermediate block 16*a* within the scope of the present disclosure.

Referring again to FIGS. 1 and 2, while the intermediate block 16*a* is shown as having a cross-sectional shape of a rectangle thereby matching the cross-sectional shape of the base member 12, it should be appreciated that in other embodiments, the intermediate block 16*a* can have other cross-sectional shapes and can have a cross-sectional shape that is different from the base member 12. In addition, while FIG. 1 illustrates the intermediate blocks 16*a*-16*e* as all having the same cross-sectional shape, in other embodiments it is contemplated that the intermediate blocks 16*a*-16*e* can have different shapes from each other. Non-limiting examples of other cross-sectional shapes include squares, rectangular, triangles, and circles. In a particular non-limiting example, each of the plurality of intermediate blocks 16*a*-16*e* has a rectangular dimension that is smaller than a rectangular dimension of the base member 12.

Referring now to FIG. 2, the intermediate block 16*a* has an intermediate block length IBL, an intermediate block width IBW and an intermediate block height IBH. In the illustrated embodiment, the intermediate block length IBL is in a range of from about 16.0 inches to about 30.0 inches, the intermediate block width IBW is in a range of from about 8.0 inches to about 20.0 inches and the intermediate block height IBH is in a range of from about 4.0 inches to about 12.0 inches. However, it should be appreciated that in other embodiments, the intermediate block length IBL can be less than about 16.0 inches or more than about 30.0 inches, the intermediate block width IBW can be less than about 8.0 inches or more than about 20.0 inches and the intermediate block height IBH can be less than about 4.0 inches or more than about 12.0 inches, sufficient for the functions described herein. In certain embodiments, the dimensions of the intermediate block 16*a* can be less than the corresponding dimensions of the base member 12 in order to provide a stable and an aesthetically pleasing structure, although such is optional and not required for successful operation of the stackable burial tower 10.

Referring again to FIG. 2, the intermediate block 16*a* includes an upper face 64 and an opposing lower face 66. The block cavity 44 extends from the upper face 64 to the lower face 66. The block cavity 44 is configured to slidably receive a housing chamber 14*a* therethrough with a clearance fit. In the illustrated embodiment, the block cavity 44 has a circular cross-sectional shape that approximates a circular cross-sectional shape of the housing chamber 14*a*. Still further to the illustrated embodiment, the block cavity 44 has a block cavity height BCH that approximates the housing chamber height HCH, such that in an installed arrangement, the upper rim 48 of the housing chamber 14*a* aligns with the upper face 64 of the intermediate block 16*a*.

Referring again to the embodiment illustrated in FIG. 2, a diameter BCD of the block cavity 44 approximates the housing chamber diameter HCD in a manner such as to slidably receive the housing chamber 14*a* with a clearance fit.

Figure 5:
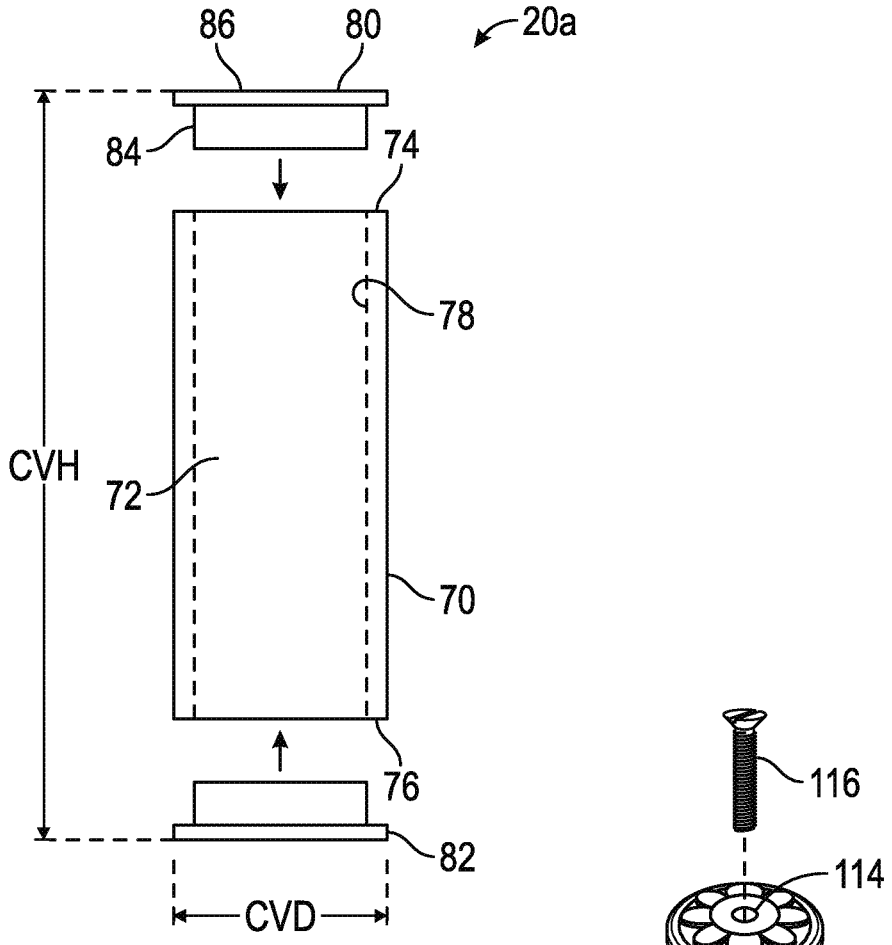
FIG. 5 is a front perspective view of a chamber vessel of the stackable burial tower of FIG. 1.

Referring now to FIGS. 1, 2 and 5, the chamber vessel 20*a* is illustrated. The chamber vessel 20*a* is representative of the chamber vessels 20*b*-20*e*. The chamber vessel 20*a* is configured for several functions. First, the chamber vessel 20*a* is configured to receive, secure and store the cremated remains of one or more persons. Second, the chamber vessel 20*a* is configured for placement within the housing chamber cavity 46.

Referring again to FIGS. 1, 2 and 5, the chamber vessel 20*a* includes a circumferential wall 70 that defines a chamber vessel cavity 72. The chamber vessel cavity 72 extends from an upper rim 74 to a lower rim 76. The chamber vessel cavity 72 is configured to receive, secure and store the cremated remains of one or more persons. The circumferential wall 70 forms an inner surface 78.

Referring now to FIG. 5, a first cap 80 is configured to seat against the upper rim 74 as shown schematically by direction arrow A and a second cap 82 is configured to seat against the lower rim 76, as shown schematically by direction arrow B. The first cap 80 is representative of the second cap 82 and includes a first portion 84 extending from a lid portion 86.

In the embodiment illustrated in FIG. 5, the chamber vessel 20*a* and the chamber vessel cavity 72 have a circular cross-sectional shape. In other embodiments, the chamber vessel 20*a* and the chamber vessel cavity 72 can have other desired cross-sectional shapes, including the non-limiting examples of square, rectangular and polygonal cross-sectional shapes.

Referring again to FIG. 5, the first portion 84 of the first cap 80 has a cross-sectional shape that approximates the cross-sectional shape of the chamber vessel cavity 72 and the lid portion 86 of the first cap has a cross-sectional shape that approximates the cross-sectional shape of the chamber vessel 20*a*.

Referring again to FIG. 5, after insertion of the cremated remains of one or more persons into the chamber vessel cavity 72, the first and second caps 80, 82 are attached to the chamber vessel 20*a* in a manner such as to secure, seal and store the cremated remains. The first and second caps 80, 82 can be attached to the chamber vessel 20*a* in any desired manner including the non-limiting examples of mating threads, friction/interference fits, adhesives and the like.

While the embodiment illustrated in FIG. 5 illustrates the use of the first and second caps 80, 82, in other embodiments, the chamber vessel 20*a* can be formed with a solid bottom thereby eliminating the use of the second cap 82.

Referring again to FIG. 5, the chamber vessel 20*a* can be formed from any non-deteriorating material. As a nonlimiting example, the chamber vessel 20*a* can be formed from composite plastic materials, aluminum-based materials, and stainless steel based materials. Desirably, the above materials can provide for a long-lasting storage solution for cremains. One of ordinary skill in the art can select other suitable materials for forming the chamber vessel 20*a* within the scope of the present disclosure.

Referring again to the embodiment illustrated in FIG. 5, a diameter CVD of the chamber vessel 20*a* is in a range of from about 3.0 inches to about 6.0 inches and a chamber vessel height CVH is in a range of from about 6.0 inches to about 10.0 inches. It should be appreciated that in other embodiments, the diameter CVD of the chamber vessel 20*a* can be less than about 3.0 inches or more than about 6.0 inches and the chamber height CVH can be less than about 6.0 inches or more than about 10.0 inches, sufficient for the functions described herein.

While the embodiment shown in FIGS. 1 and 2 illustrates the concept of using the plurality of chamber vessels 20*a*-20*e* to secure and store cremated remains, it is further contemplated that in other embodiments, the cremated remains can be directly placed within the housing chambers 14*a*-14*e* without the use of the chamber vessels 20*a*-20*e*.

Figure 6:
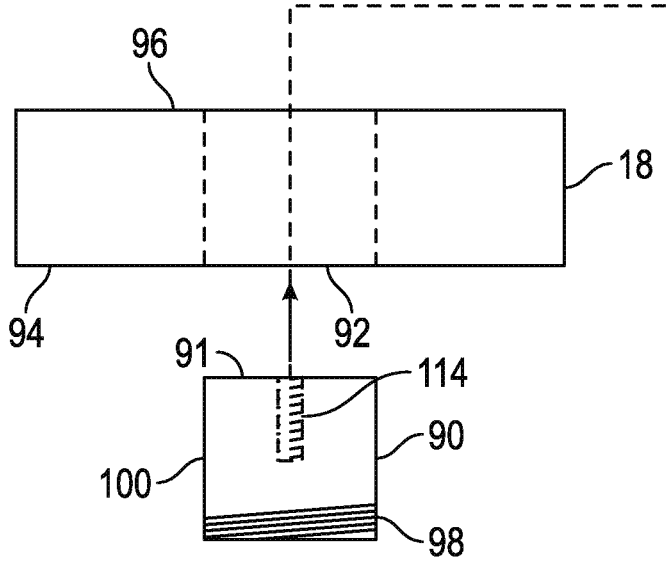
FIG. 6 is a side view of a cap block and cap sleeve of the stackable burial tower of FIG. 1.

Referring now to FIG. 6, the cap block 18 and a cap sleeve 90 are illustrated. The cap block 18 includes a cap block cavity 92 that extends from a lower face 94 to an upper face 96. The cap block cavity 92 is configured to receive the cap sleeve 90 in a manner similar to that of housing chamber 14*a* being received by the intermediate block 16*a*. That is, in an installed position, an upper surface 91 of the cap sleeve 90 aligns with the upper face 96 of the cap block 18.

In the illustrated embodiment, the cap block 18 has the same dimensions and cross-sectional shape as the intermediate blocks 16*a*-16*c* and is made from the same materials. However, it is contemplated that in other embodiments, the cap block can have different dimensions, a different cross-sectional shape and can be formed from different materials than the intermediate blocks 16*a*-16*c*.

Referring again to FIG. 6, the cap sleeve 90 includes a plurality of sleeve threads 98 extending from an outer surface 100 of the cap sleeve 90. The sleeve threads 98 are configured to threadably engage the inner housing chamber threads 58 of an adjacent housing chamber. In the illustrated embodiment, the cap sleeve 90 has the same dimensions and cross-sectional shape as the base sleeve 26 and is made from the same materials. However, it is contemplated that in other embodiments, the cap sleeve 90 can have different dimensions, a different cross-sectional shape and can be formed from different materials than the base sleeve 26.

Referring again to FIG. 6, a decorative member 112 is seated against the upper face 96 of the cap block 18 and a clearance aperture 114 located within the decorative member 112 aligns with a threaded aperture 114 within the cap sleeve 90. The decorative member 112 is configured as a decorative washer for a fastener 116 extending through the decorative member 112 and into the threaded aperture 114 of the cap sleeve 90. The cap sleeve 90, the decorative member 112 and the fastener 116 cooperate to retain the cap block 18 in an installed position. The decorative member 112 can have any desired appearance and can be made of any desired materials sufficient for the functions described herein.

Referring now to FIGS. 1 and 2, assembly of the burial tower 10 will now be described. In a first assembly step, the base sleeve 26 is inserted into the base cavity 24 of the base member 12 in a manner such that the internal sleeve threads 40 are exposed. In a next step, the housing chamber 14*a* is positioned in a manner such that the outer housing chamber threads 60 engage the internal sleeve threads 40 in the base sleeve 26. The outer housing chamber threads 60 and the sleeve threads 40 are tightened together, thereby forming an initial spinal structure configured to structurally support the intermediate blocks 16*a*-16*d*. In a next assembly step, the chamber vessel 20*a*-20*e*, complete with the sealed and cremated remains of one or more cremated persons, is inserted into the housing chamber cavity 46.

In a next step, the block cavity 44 of the intermediate block 16*a* is aligned with the upper rim 48 of the housing chamber 14*a* and the intermediate block 16*a* is lowered over the housing chamber 14*a* until the intermediate block 16*a* seats upon the base member 12. In this position, the upper rim 48 of the housing chamber 14*a* aligns with the upper face 64 of the intermediate block 16*a*.

Referring again to FIGS. 1 and 2, additional layers of housing chambers, intermediate blocks and chamber vessels are assembled in successive order, for example, where successive housing chambers are attached to each other in an end-to-end arrangement, as described above until a desired quantity of chamber vessels is achieved. While the embodiment illustrated in FIG. 1 shows a quantity of five housing chambers 14*a*-14*e*, each housing a chamber vessel 20*a*-20*e* respectively, it should be appreciated that in other embodiments, more or less than five layers can be assembled. It should also be appreciated that the stackable burial tower 10 can be expanded upon multiple times and does not have a set number of personal remains that the stackable burial tower 10 can accommodate. In these embodiments, each level of the stackable burial tower 10 can interlock with adjacent levels, however, each level remains fully functional as its own individual housing chamber 14*a*-14*e*. It is further contemplated that the stackable burial tower 10 can have additional layers added to accommodate larger burial groups or the sudden passing of an individual. However, after a family is done adding layers to their stackable burial tower, the cap block 18 can be added to complete the stackable burial tower 10 top.

Referring again to FIGS. 1 and 2, in a next assembly step, the cap sleeve 90 is connected to the adjacent housing chamber 14*e*. Next, the cap block 18 is installed over the cap sleeve 90 in a manner such that the cap block 18 seats upon the uppermost intermediate block 16*e*. In a final assembly step, the decorative member 112 and the threaded fastener 116 are installed over the cap sleeve 90 and the threaded fastener 116 engages the threaded aperture 114 in the cap sleeve 90. The threaded fastener is tightened, thereby securing the decorative member 112 to the cap sleeve 90.

The stackable burial tower 10 provides many advantages, although all advantages may not be available in all embodiments. First, the stackable nature of the stackable burial tower 10 provides for space conscious storage of cremated remains. Second, the stackable burial tower 10 is customizable, thereby allowing for individualization in memorializing the cremated remains. Third, the stackable burial tower 10 provides additional marketing opportunities to land locked cemeteries who may lack the opportunity of expansion. Fourth, the stackable burial tower 10 advantageously provides families the opportunity to keep their loved ones in a singular location. Fifth, the stackable burial tower 10 can be expanded upon multiple times and does not have a set number of individuals the tower can accommodate. Sixth, advantageously, the cremated remains are safely secured and stored within the chamber vessels 20*a*-20*e*, which are in turn, safely secured and stored within the intermediate blocks 16*a*-16*e*. Finally, the stackable burial tower 10 provides additional vertical space above preexisting graves to be utilized and designated for a specific use.

Figure 7:
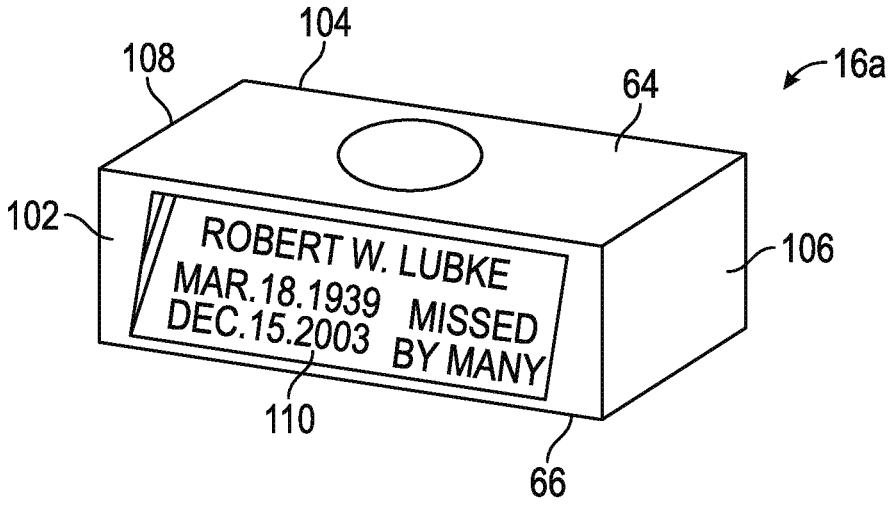
FIG. 7 is a front perspective view of a second embodiment of an intermediate block of the stackable burial tower of FIG. 1.

Referring now to FIG. 7, an intermediate block 16*a* is illustrated and is representative of the intermediate blocks 16*b*-16*e*. The intermediate block 16*a* includes side faces 102, 104 and end faces 106, 108. It is contemplated that optionally one or more of the faces 102, 104, 106, 108 can include indicia 110 memorializing the cremated remains contained therein. The indicia 110 can have any desired form including the non-limiting examples of engravings, photographs, plaques, appliques and the like.

Figure 8:
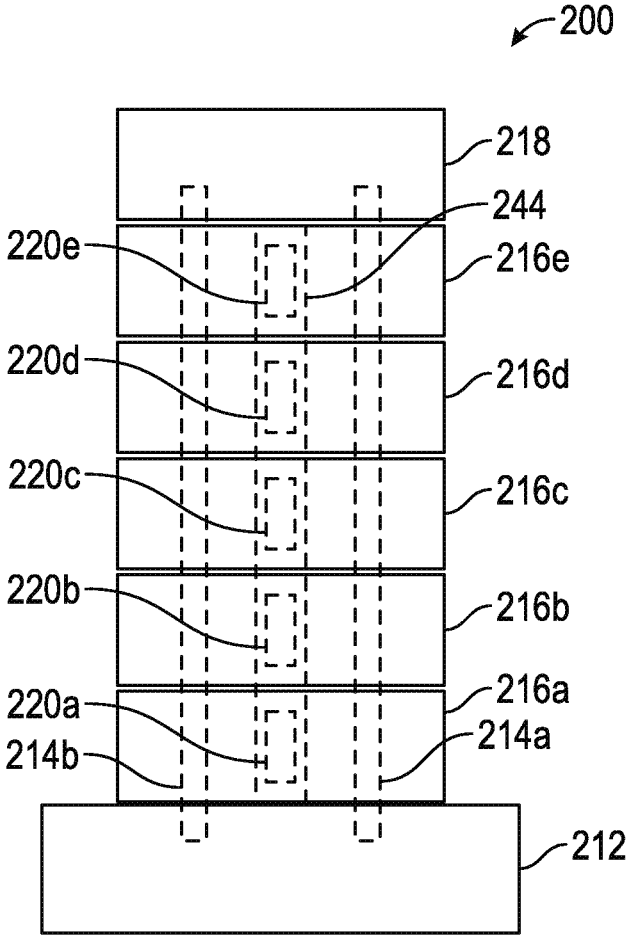
FIG. 8 is a front view of a second embodiment of a stackable burial tower, in accordance with the present disclosure.

It is further contemplated that the stackable burial tower can have other forms. Referring now to FIG. 8, an alternate non-limiting embodiment of a stackable burial tower is shown generally at 200. The stackable burial tower 200 includes a base member 212, a plurality of reinforcing rods 214*a*, 214*b*, a plurality of intermediate blocks 216*a*-216*e*, a cap block 218 and a plurality of chamber containers 220*a*-220*e*. In the illustrated embodiment, the base member 212, the plurality of intermediate blocks 216*a*-216*e*, the cap block 218 and the plurality of chamber containers 220*a*-220*e* are the same as, or similar to, the base member 12, the plurality of intermediate blocks 16*a*-16*e*, the cap block 18 and the plurality of chamber containers 20*a*-20*e* shown in FIG. 1 and described above. In other embodiments, the base member 212, the plurality of intermediate blocks 216*a*-216*e*, the cap block 218 and the plurality of chamber containers 220*a*-220*e* can be different from the base member 12, the plurality of intermediate blocks 16*a*-16*e*, the cap block 18 and the plurality of chamber containers 20*a*-20*e*.

Referring again to FIG. 8, each of the reinforcing rods 214*a*, 214*b* extends from the base member 212, through the intermediate blocks 216*a*-216*e* and into the cap block 218, thereby forming a spinal structure configured to support the stacked intermediate blocks 216*a*-216*e* and the chamber containers 220*a*-220*e*. The reinforcing rods 214*a*, 214*b* can have any desired form, including the non-limiting example of a circular elongated rod.

Referring again to FIG. 8, the chamber containers 220*a*-220*e* are positioned within block cavities 244 formed within each of the intermediate blocks 216*a*-216*e*. In this manner, the housing chambers 14*a*-14*e* shown in FIGS. 1 and 2 can advantageously be eliminated.

Example embodiments are provided so that this disclosure will be thorough, and will fully convey the scope to those who are skilled in the art. Numerous specific details are set forth such as examples of specific components, devices, and methods to provide a thorough understanding of the embodiments of the present disclosure. It will be apparent to those skilled in the art that specific details need to be employed, that example embodiments may be embodied in many different forms, and that neither should be construed to limit the scope of the disclosure. In some example embodiments, well-known processes, well-known device structures and well-known technologies are not described in detail. Equivalent changes, modifications, and variations of some embodiments, materials, compositions, and methods may be made within the scope of the present technology, with substantially similar results.

What is claimed is:

1. A stackable burial tower configured to store cremated remains, comprising:

a base member including a base cavity configured to receive a base sleeve, the base sleeve having sleeve threads on an inner surface;

a plurality of intermediate blocks, each configured to stack on the base member or on each other thereby, in combination with the base member, forming a tower;

a spinal structure extending from the base member through the plurality of intermediate blocks; and a plurality of chamber vessels configured to store cremated remains, each of the plurality of chamber vessels positioned within one of the plurality of intermediate blocks.

2. The stackable burial tower of claim 1, wherein the base member has a rectangular cross-sectional shape.

3. The stackable burial tower of claim 1, wherein the base member is formed of granite based material.

4. The stackable burial tower of claim 1, wherein each of the plurality of intermediate blocks has a rectangular cross-sectional shape.

5. The stackable burial tower of claim 1, wherein each of the plurality of intermediate blocks has a rectangular dimension that is smaller than a rectangular dimension of the base member.

6. The stackable burial tower of claim 1, wherein each of the plurality of intermediate blocks is formed of granite based material.

7. The stackable burial tower of claim 1, wherein each of the plurality of intermediate blocks includes a block cavity that extends from an upper face to a lower face.

8. The stackable burial tower of claim 1, wherein the spinal structure includes a plurality of reinforcing rods.

9. A stackable burial tower configured to store cremated remains, comprising:

a base member including a base cavity configured to receive a base sleeve;

a plurality of intermediate blocks, each configured to stack on the base member or on each other thereby, in combination with the base member, forming a tower;

a spinal structure extending from the base member through the plurality of intermediate blocks; and a plurality of chamber vessels configured to store cremated remains, each of the plurality of chamber vessels positioned within one of the plurality of intermediate blocks, wherein the spinal structure includes a plurality of housing chambers, a first housing chamber of the plurality of housing chambers is attached to the base sleeve with a mating thread arrangement.

10. The stackable burial tower of claim 9, wherein successive housing chambers are attached to each other in an end-to-end arrangement.

11. The stackable burial tower of claim 10, wherein successive housing chambers are attached to each other with a mating thread arrangement.

12. The stackable burial tower of claim 10, wherein each of the plurality of chamber vessels is positioned within a housing chamber, which in turn is positioned within one of the plurality of intermediate blocks.

13. A stackable burial tower configured to store cremated remains, comprising:

a base member;

a plurality of intermediate blocks, each configured to stack on the base member or on each other thereby, in combination with the base member, forming a tower;

a spinal structure extending from the base member through the plurality of intermediate blocks; and a plurality of chamber vessels configured to store cremated remains, each of the plurality of chamber vessels positioned within one of the plurality of intermediate blocks, wherein a cap block is seated on an uppermost intermediate block, the cap block including a cap block cavity configured to receive a cap block sleeve including sleeve threads on an outer surface.

* * * * *